United States Patent [19]

Petersen et al.

[11] Patent Number: 4,630,815

[45] Date of Patent: Dec. 23, 1986

[54] QUICK RELEASING, PINCH ROLLER MECHANISM

[75] Inventors: Borge Petersen, Elmira; Rickard P. Nally, Waterloo, both of Canada

[73] Assignee: NCR Corporation, Dayton, Ohio

[21] Appl. No.: 807,563

[22] Filed: Dec. 11, 1985

[51] Int. Cl.[4] ..... B65H 5/06

[52] U.S. Cl. ..... 271/273

[58] Field of Search ..... 271/273, 274

[56] References Cited

U.S. PATENT DOCUMENTS 4,170,350 10/1979 Conti ..... 271/274
4,442,769 4/1984 Kallin ..... 101/93.19
4,561,352 12/1985 Suyatsky ..... 271/273 X

OTHER PUBLICATIONS

IBM Technical Disclosure Bulletin, vol. 17, No. 6, pp. 1745–1746, Nov. 1974, "Transport Assembly and Latch . . . ", W. E. Bench.

*Primary Examiner*—Richard A. Schacher
*Attorney, Agent, or Firm*—Wilbert Hawk, Jr.; Albert L. Sessler, Jr.; Elmer Wargo

[57] ABSTRACT

A quick-release mechanism which enables a pinch roller to be moved quickly from its active position with its associated driving roller to a retracted position to enable an operator to remove a jammed document from the area of a document track where the jam occurs.

8 Claims, 4 Drawing Figures

QUICK RELEASING, PINCH ROLLER MECHANISM

BACKGROUND OF THE INVENTION

This invention relates generally to a document feeding mechanism which utilizes a driving roller and a pinch roller to feed documents therebetween in a document track. More specifically, it relates to a quick-release mechanism which enables the pinch roller to be moved quickly from its operating position in association with the driving roller to a retracted position away from the driving roller to facilitate the removal of a document which may be jammed in the document track.

One of the problems which occurs with document feeding mechanisms of the prior art is that it is sometimes difficult to extract a document which gets jammed in a document track. Generally, the jamming of a document occurs near a reading head (like an optical read head or a magnetic read head) which is located in the document track associated with financial business machines like encoders or proofing machines, for example. Generally, there is a driving roller and a pinch roller located in the document track on the upstream and downstream sides of the reading head mentioned. By the time a jammed document is removed from the document track under prior art constructions, the jammed document may become crumpled or ripped.

SUMMARY OF THE INVENTION

The present invention obviates the problem mentioned earlier herein in that it provides a means for quickly releasing the pinch roller from its active position with an associated driving roller. The present invention is also simple to operate and inexpensive to produce.

A preferred embodiment of the invention comprises: a base; a document track mounted on said base; a driving roller mounted on one side of said document track to move documents in said document track in cooperation with a pinch roller; a pinch roller; mounting means for mounting said pinch roller for movement between an active position in which said pinch roller cooperates with said driving roller to move documents in said document track and a retracted position in which said pinch roller is moved away from said driving roller to facilitate removing a jammed document from said document track; and moving means coupled to said mounting means for moving said pinch roller between said active and retracted positions.

The advantages of this invention will be more readily understood in connection with the following specification, claims and drawing.

DETAILED DESCRIPTION OF THE INVENTION

Figure 1:
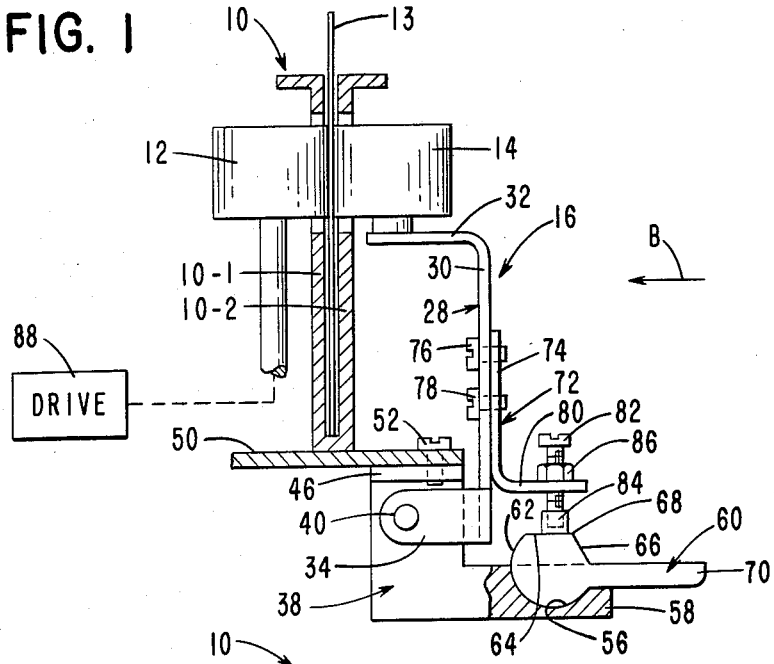
FIG. 1 is an end view, in elevation, of the mechanism of this invention, looking in the downstream direction along a document track (as viewed from the direction of arrow A of FIG. 4), showing a document being driven between a driving roller and its associated pinch roller, with the pinch roller in the active position.

FIG. 1 shows a document track 10 with which this invention may be used. The document track 10 may be part of financial machines such as check sorters, bank proofing machines, or encoders, for example. In general, documents are moved in the document track 10 to various processing stations along the length of the track 10.

The documents like 13 (FIG. 1) are moved in the document track 10 generally, by a driving roller 12 and its associated pinch roller 14. In the embodiment described, the pinch roller 14 is rotatably mounted on a quick-releasing mechanism which will be referred to hereinafter as mechanism 16. When the mechanism 16 and the pinch roller 14 are in the active position shown in FIG. 1, the pinch roller 14 cooperates with the driving roller 12 to move the document 13 therebetween, and when the mechanism 16 and the pinch roller 14 are in the inactive position shown in FIG. 2, there is no feeding or moving of a document 13 by the driving roller 12 and the pinch roller 14. Before discussing the mechanism 16 in detail, it appears appropriate to discuss a typical environment in which the mechanism 16 may be used.

Figure 4:
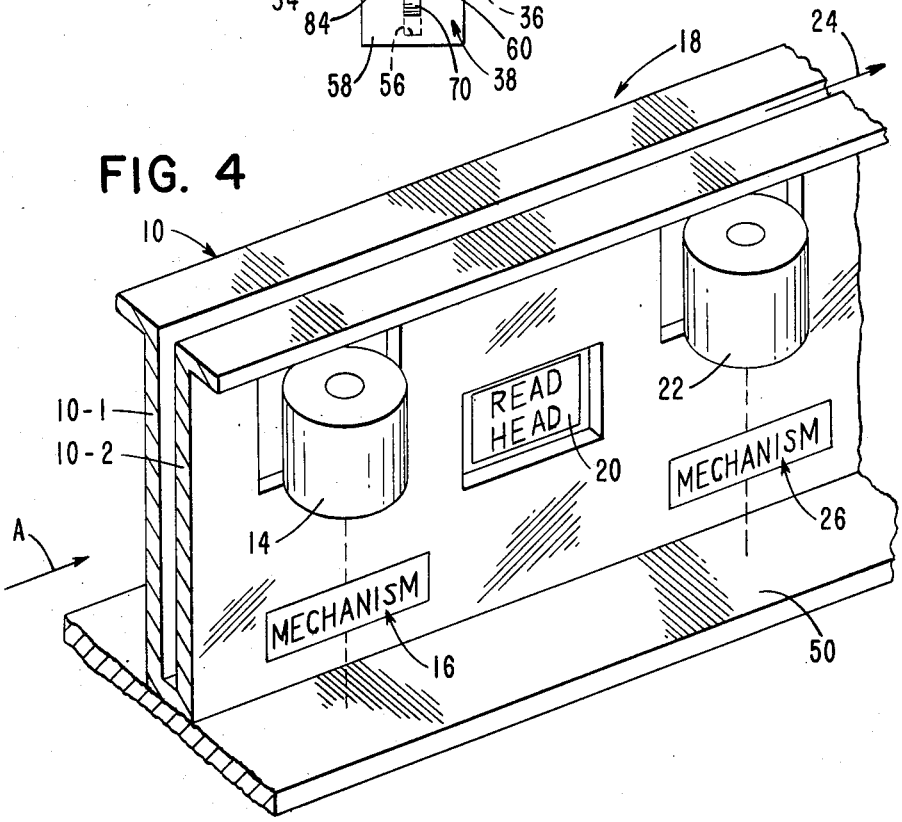
FIG. 4 is a general view, in perspective, showing a typical environment in which the mechanism of this invention may be used.

FIG. 4 shows a portion of a typical financial machine designated generally as 18 in which the mechanism 16 may be used. The machine portion 18 may include a read head 20 (shown only schematically in FIG. 4) which may be used to read optical data on a document like a check. Also, the read head 20 may be a magnetic read head for reading magnetic ink character recognition (MICR) data on the documents. With such an arrangement as that shown in FIG. 4, there generally is provided a driving roller 12 and its associated pinch roller 14 located on the upstream side of the read head 20 and another driving roller (not shown) and its associated pinch roller 22 located on the downstream side of the read head 20 for feeding the documents past the read head 20, with the feeding direction being indicated by arrow 24.

As stated earlier herein, one of the problems with the general feeding arrangements described in relation to FIG. 4 was that a document which jammed in the area of the associated read head was difficult to extract; however, with the arrangement shown in FIG. 4, the mechanism 16 provides a quick way of releasing the pinch roller 14 from its associated driving roller 12, and similarly, the mechanism 26 (which is identical to mechanism 16) provides a quick way of releasing the pinch roller 22. When the pinch rollers 14 and 22 are quickly released, the driving rollers, like 12, are no longer effective in attempting to move the jammed document; consequently, less damage is done to the document. For example, if the leading edge of a document is jammed at the reader 20, the driving roller 12 and its associated pinch roller 14 (when coupled together) may cause the document to crumple or to be abraded due to the "scrubbing" action of the rollers 12 and 14. Quickness in removing the jammed document under these circumstances minimizes the damage done to the document. The mechanisms 16 and 26 facilitate the quick removal of jammed documents.

The mechanism 16 (FIGS. 1–3) includes a frame 28 which may be stamped out of sheet metal and formed into the shape shown. The frame 28 includes a straight portion 30 having a ninety degree bend at one end thereof to produce an offset portion 32 on which the pinch roller 14 is rotatably mounted. The lower end (as viewed in FIGS. 1–3) of the frame 28 has first and second offset portions 34 and 36 which are spaced apart in parallel relationship to receive therebetween the mounting block designated generally as 38. The mounting block 38 and the first and second portions 34 and 36 have aligned holes (not shown) therein to receive a mounting pin 40 to enable the frame 28 to be pivotally mounted thereon for movement between the active position shown in FIG. 1 and the inactive or retracted position shown in FIG. 2. The frame 28 is retained on the pin 40 by suitable "C" washers 42 and 44 (FIG. 3) fitting into mating recesses (not shown) on the pin 40.

The mounting block 38 (FIGS. 1–3) has flanges 46 and 48 extending therefrom to enable it to be secured to the underside of the base plate 50 by fasteners 52 and 54. The mounting block 38 is also "L"-shaped, as viewed in FIGS. 1 and 2, with an arcuately-shaped slot or recess 56 being formed in the leg 58 of the block 38. A planar, actuating lever 60 is positioned in the arcuately-shaped recess 56 as shown. The mounting block 38 also has a slot as shown at area 57 in FIG. 2 which communicates with the arcuately-shaped recess 56 to enable the lever 60 to be moved to the position shown in FIG. 1.

Figure 2:
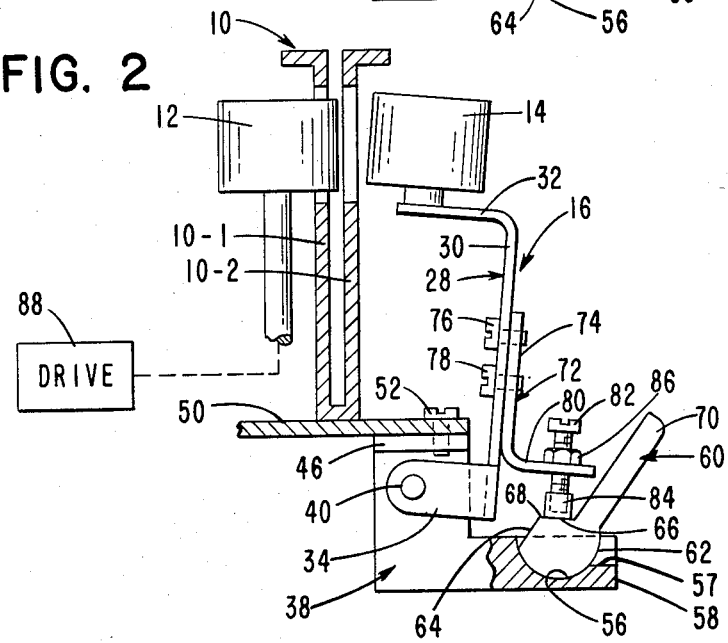
FIG. 2 is a view similar to FIG. 1 showing the pinch roller in a retracted position.
Figure 3:
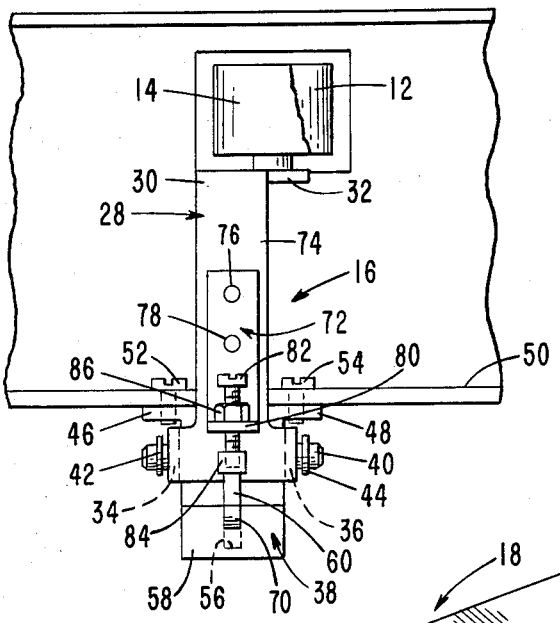
FIG. 3 is a side view, in elevation, which is taken from the direction of arrow B shown in FIG. 1.

The actuating lever 60 (FIGS. 1–2) has an arcuately-shaped portion 62 which is complementary in shape to the arcuately-shaped recess 56 in the mounting block 38 to enable the actuating lever to be pivoted between the first or active position shown in FIG. 1 and the second or retracted position shown in FIG. 2. The actuating lever 60 has a first, flat portion 64, a second, flat portion 66, and a third or joining portion 68 positioned therebetween as shown to provide a smooth transition between the first and second flat portions 64 and 66. The actuating lever 60 also has a handle 70 which is moved quickly by an operator from the position shown in FIG. 1 to the position shown in FIG. 2 when a document jam occurs. Because the actuating lever is planar, it may be formed by stamping, for example, to minimize the cost of producing the mechanism 16.

The means for coupling the actuating lever 60 to the frame 28 includes the "L"-shaped bracket 72 having one leg 74 secured to the frame 28 by fasteners 76 and 78, with the remaining leg 80 being positioned over the first flat portion 64 of the actuating lever 60 when the lever 60 is in the position shown in FIG. 1. A fastener 82 (providing a means for adjusting the pressure between the pinch roller 14 and its associated driving roller 12) is part of the coupling between the bracket 72 and the actuating lever 60. The fastener 82 is threadedly received in the leg 80 and has a cylindrically-shaped, plastic boot 84 on its lower end to minimize the wear on the actuating lever 60. The fastener 82 may be advanced to increase the pressure of pinch roller 14 against the drive roller 12 or it may be withdrawn to decrease the named pressure. A locking nut 86 is used to retain the fastener 82 in the adjusted position.

In assembling the mechanism 16, the actuating lever 60 is positioned in the arcuately-shaped recess 56 in the mounting block 38, and thereafter the frame 28 and the bracket 72, with the fastener 82 thereon, are pivotally mounted on the pin 40 in the mounting block 38. Thereafter, the mounting block 38 is secured to the underside of the base plate 50, and the pressure between the rollers 12 and 14 is adjusted as previously described. In the embodiment described, the pressure between the rollers 12 and 14 is adjusted to about a force of one pound along the line of contact therebetween.

As previously stated, FIG. 1 shows the mechanism 16 in an active position. When a jam in feeding a document 13 occurs, the handle 70 of the actuating lever 60 is moved upwardly (as viewed in FIG. 1) to the position shown in FIG. 2. In moving the handle 70 from the position shown in FIG. 1 to the position shown in FIG. 2, the fastener 82 (with the plastic boot 84 thereon) rides over the joining portion 68 of the actuating lever 60 to thereby momentarily increase the pressure of the pinch roller 14 against the driving roller 12 before the pressure between these rollers 12 and 14 is relieved as shown in FIG. 2. In effect, the joining portion 68 on the actuating lever 60 acts as a dead center position, with the pinch roller 14 being retained in the active and retracted positions shown in FIGS. 1 and 2 by the first and second flat portion 64 and 66, respectively. Naturally, at least one of the rollers 12 and 14 is sufficiently compressible to enable the actuating lever 60 to be moved over the joining portion 68 in moving between the positions shown in FIGS. 1 and 2. After the jammed document 13 is removed from the document track 10, the actuating lever 60 for each of the mechanisms 16 and 26 may be moved to the active position shown in FIG. 1.

Some miscellaneous comments appear in order. The driving roller 12 is considered a driving roller in relation to the pinch roller 14; however, the driving roller 12 is rotated or driven by a conventional drive which is shown only schematically as drive 88. The document track 10 includes the side walls 10-1 and 10-2 which are upstanding from and secured to the base plate 50. While the mounting block 38 is shown as metal, it may be made of a suitable plastic material to reduce costs. The mechanisms 16 and 26 (FIG. 4) are shown only schematically in being coupled to their associated pinch rollers 14 and 22, respectively, and the base plate 50. The mechanism 16 can be provided as a separate assembly for sale.

What is claimed is:

1. A quick-releasing, pinch roller mechanism comprising:

a base plate;

a document track upstanding from said base plate;

a driving roller mounted on one side of said document track to move documents in said document track in cooperation with a pinch roller;

a pinch roller;

a mounting block having fastener means for detachably mounting said mounting block on said base plate;

said mounting block having a mounting pin thereon and also having an arcuately-shaped recess therein;

a frame having first and second ends with said first end being pivotally mounted on said pin and with said pinch roller being rotatably mounted on said second end to enable said frame to be pivoted between an active position in which said pinch roller is in operating engagement with said driving roller and a retracted position in which said pinch roller is spaced from said driving roller to facilitate removing a jammed document from said document track;

an actuating lever having thereon an arcuately-shaped portion which is complementary in shape to said arcuately-shaped recess to enable said lever to be pivoted in said arcuately-shaped recess between first and second positions; and coupling means secured to said frame and cooperating with said actuating lever to move said frame to said active and retracted positions when said actuating lever is moved to said first and second positions, respectively.

2. The quick-releasing, pinch roller mechanism as claimed in claim 1 in which said coupling means includes adjusting means for adjusting the pressure between said driving roller and said pinch roller when said frame is in said active position.

3. The quick-releasing, pinch roller mechanism as claimed in claim 2 in which at least said pinch roller is compressible and in which said actuating lever has first, second, and third areas thereon, with said second area being positioned between said first and third areas and representing a dead center position to enable said frame to be retained in said active position when said actuating lever is moved from said second position to said first position.

4. The quick-releasing, pinch roller mechanism as claimed in claim 3 in which said coupling means includes a bracket which is secured to said frame, and said adjusting means includes an adjusting screw which is mounted on said bracket and has an end to coact with said first, second and third areas on said actuating lever; and said end of said adjusting screw having a plastic boot thereon to minimize the wear on said first, second and third areas of said actuating lever.

5. The combination comprising:

a base plate;

a document track upstanding from said base plate;

reading means for reading data from documents moving in said document track;

a first, quick-releasing, pinch roller mechanism and an associated driving roller located upstream relative to a document feeding direction, from said reading means; and a second, quick-releasing, pinch roller mechanism and an associated driving roller located downstream, relative to said document feeding direction, from said reading means;

said first and second, quick-releasing, pinch roller mechanisms being identical, and said first, quick-releasing, pinch roller mechanism comprising:

a pinch roller;

said associated driving roller being mounted on one side of said document track to move said documents in said document track in cooperation with said pinch roller;

a mounting block having fastener means for detachably mounting said mounting block on said base plate;

said mounting block having a mounting pin thereon and also having an arcuately-shaped recess therein;

a frame having first and second ends with said first end being pivotally mounted on said pin and with said pinch roller being rotatably mounted on said second end to enable said frame to be pivoted between an active position in which said pinch roller is in operating engagement with said associated driving roller and a retracted position in which said pinch roller is spaced from said associated driving roller to facilitate removing a jammed document from said document track;

an actuating lever having thereon an arcuately-shaped portion which is complementary in shape to said arcuately-shaped recess to enable said lever to be pivoted in said arcuately-shaped recess between first and second positions; and coupling means secured to said frame and cooperating with said actuating lever to move said frame to said active and retracted positions when said actuating lever is moved to said first and second positions, respectively.

6. The combination as claimed in claim 5 in which said coupling means includes adjusting means for adjusting the pressure between said associated driving roller and said pinch roller when said frame is in said active position.

7. The combination as claimed in claim 6 in which at least said pinch roller is compressible and in which said actuating lever has first, second, and third areas thereon, with said second area being positioned between said first and third areas and representing a dead center position to enable said frame to be retained in said active position when said actuating lever is moved from said second position to said first position.

8. The combination as claimed in claim 7 in which said coupling means includes a bracket which is secured to said frame, and said adjusting means includes an adjusting screw which is mounted on said bracket and has an end to coact with said first, second and third areas on said actuating lever; and said end of said adjusting screw having a plastic boot thereon to minimize the wear on said first, second and third areas of said actuating lever.

* * * * *